US007565854B2

(12) United States Patent
Chiang et al.

(10) Patent No.: US 7,565,854 B2
(45) Date of Patent: Jul. 28, 2009

(54) TOOL RETAINING DEVICE FOR POWER TOOL

(75) Inventors: Wen Hung Chiang, Taichung Hsien (TW); Shu-Ying Chuang Chiu, Taichung Hsien (TW)

(73) Assignee: Hsin Ying Enterprise Co., Ltd., Wantien Tsuen, Dadu Hsiang, Taichung Hsien (TW)

( * ) Notice: Subject to any disclaimer, the term of this patent is extended or adjusted under 35 U.S.C. 154(b) by 77 days.

(21) Appl. No.: 11/980,933

(22) Filed: Oct. 31, 2007

(65) Prior Publication Data

US 2009/0107304 A1 Apr. 30, 2009

(51) Int. Cl.
*B25B 23/14* (2006.01)

(52) U.S. Cl. ..... 81/467; 81/429; 81/451; 279/75; 279/905

(58) Field of Classification Search ..... 81/467, 81/429, 438, 451; 279/75, 905, 30, 74, 906
See application file for complete search history.

(56) References Cited

U.S. PATENT DOCUMENTS

| | | | | |
|---|---|---|---|---|
| 4,753,142 | A | 6/1988 | Hornnug | 81/429 |
| 5,775,186 | A | 7/1998 | Rahm | 81/474 |
| 5,996,452 | A | 12/1999 | Chiang | 81/429 |
| 6,931,967 | B1 * | 8/2005 | Chang | 81/451 |
| 7,387,054 | B2 * | 6/2008 | Rajotte | 81/429 |

* cited by examiner

*Primary Examiner*—D. S Meislin
(74) *Attorney, Agent, or Firm*—Charles E. Baxley

(57) ABSTRACT

A tool retaining device includes a tool stem having a compartment for receiving a tool member, and one or more apertures and one or more openings for receiving one or more detent and one or more locking balls, and a barrel engaged onto the tool stem and having one or more peripheral slots and peripheral recesses for selectively receiving the detents and the locking balls respectively, and the barrel includes a peripheral actuator for actuating the detent to engage with the tool member, and another actuator for actuating the locking ball to rotatably securing the tool member to the tool stem when the peripheral actuator is disengaged from the detent.

8 Claims, 5 Drawing Sheets

TOOL RETAINING DEVICE FOR POWER TOOL

BACKGROUND OF THE INVENTION

1. Field of the Invention

The present invention relates to a tool retaining device, and more particularly to a tool retaining device for a power tool including a chuck device or structure for detachably securing a tool member to a power tool and for allowing the tool member to be driven by the power tool with a predetermined driving torque.

2. Description of the Prior Art

Typical tool retaining devices or chuck devices are provided for detachably securing a tool member to a power tool and for allowing the tool member to be rotated or driven by the power tool, and comprise a sleeve slidably attached or engaged onto a chuck shaft and engageable with one or more detents or locking balls for forcing the detents or locking balls to engage with the tool member and thus for selectively and detachably securing the tool member to the power tool.

For example, U.S. Pat. No. 4,753,142 to Hornüng discloses one of the typical power driven screwing heads comprising a chuck shaft having an engaging hole formed therein for receiving a tool member, and a sleeve slidably attached or engaged onto the chuck shaft and engageable with one or more detents or locking balls for forcing the detents or locking balls to engage with the tool member and for selectively and detachably securing the tool member to the power tool.

However, after the fasteners that are engaged with and rotated or driven by the tool member have been fully rotated or screwed into the work pieces, the fasteners and the tool member may still be rotated or driven by the power tool such that the fasteners may have a good chance to be damaged by the power tool.

U.S. Pat. No. 5,775,186 to Rahm discloses another typical power screw driver comprising an output shaft having an engaging hole formed therein for detachably receiving a tool member.

However, similarly, the driving torque of the fasteners by the tool member and the power tool may not be predetermined such that the fasteners may also have a good chance to be continuously rotated or driven by the power tool and to be damaged by the power tool.

U.S. Pat. No. 5,996,452 to Chiang discloses a further typical chuck device for a power tool also comprising a follower having an engaging hole formed therein for detachably receiving a tool member, and a tube slidably attached or engaged onto the follower and engageable with one or more detents or locking balls for forcing the detents or locking balls to engage with the tool member and thus for selectively and detachably securing the tool member to the power tool.

However, similarly, the driving torque of the fasteners by the tool member and the power tool may not be predetermined such that the fasteners may also have a good chance to be continuously rotated or driven by the power tool and to be damaged by the power tool.

The present invention has arisen to mitigate and/or obviate the afore-described disadvantages of the conventional tool retaining devices for power tools.

SUMMARY OF THE INVENTION

The primary objective of the present invention is to provide a tool retaining device for a power tool including a chuck device or structure for detachably securing a tool member to a power tool and for allowing the tool member to be driven by the power tool with a predetermined driving torque.

In accordance with one aspect of the invention, there is provided a tool retaining device comprising a tool stem including an engaging segment having a compartment formed in the engaging segment, and including at least one aperture formed in the engaging segment and communicating with the compartment of the tool stem, and including at least one opening formed in the engaging segment and communicating with the compartment of the tool stem, a tool member receivable and engageable into the compartment of the engaging segment of the tool stem and including a peripheral groove formed in an outer peripheral portion thereof, at least one detent slidably received and engaged with the aperture of the tool stem and selectively engageable into the compartment of the tool stem for selectively engaging with the tool member and for anchoring the tool member to the tool stem and for allowing the tool member to be rotated and driven by the tool stem, at least one locking ball slidably received and engaged with the opening of the tool stem and selectively engageable into the compartment of the tool stem for selectively engaging with the tool member and for rotatably anchoring and securing the tool member to the tool stem and for preventing the tool member from being disengaged from the tool stem, and a barrel slidably and rotatably engaged onto the tool stem, and including a bore formed therein for slidably and rotatably receiving the tool stem, and including at least one peripheral slot and at least one peripheral recess formed in the barrel for selectively receiving the detent and the locking ball respectively and for allowing the detent and the locking ball to be selectively disengaged from the tool member, and the barrel including a first actuator formed by and located beside the peripheral slot of the barrel for selectively engaging with the detent and for selectively actuating the detent to engage into the compartment of the tool stem and to selectively engage with the tool member, and the barrel including a second actuator formed by and located beside the peripheral recess of the barrel for selectively engaging with the locking ball and for selectively actuating the locking ball to engage into the compartment of the tool stem and to selectively engage with the peripheral groove of the tool member, and the peripheral recess of the barrel is disengaged from the locking ball and the locking ball is actuated to engage with the peripheral groove of the tool member by the second actuator when the first actuator is disengaged from the detent and when the detent is received in the peripheral slot of the barrel, in order to lock the tool member to the tool stem and to prevent the tool member from being disengaged from the tool stem, and to allow the tool member to be freely rotated relative to the tool stem, and the detent is disengaged from the peripheral slot of the barrel, and the first actuator is engageable with the detent when the second actuator is disengaged from the locking ball and when the locking ball is received in the peripheral recess of the barrel to allow the tool member to be selectively engaged into or disengaged from the compartment of the tool stem.

The tool stem includes an outer peripheral shoulder formed therein, and the barrel includes a peripheral rib extended into the bore of the barrel for engaging with the outer peripheral shoulder of the tool stem and for limiting the barrel to slide relative to the tool stem.

A spring biasing member may further be provided and engaged onto the tool stem and engaged with the peripheral rib of the barrel for biasing the peripheral rib of the barrel toward the outer peripheral shoulder of the tool stem.

A sleeve may further be provided and engaged onto the tool stem and engaged with the spring biasing member, and includes a bore formed therein for receiving the spring biasing member and for partially receiving the barrel.

The barrel includes an outer thread formed thereon, and a control ferrule includes an inner thread formed therein for threading and engaging with the outer thread of the barrel and includes a free end portion extended out of the barrel for engaging with a work piece.

A lock nut may further be provided and threaded and engaged with the outer thread of the barrel and engageable with the control ferrule for securing and anchoring the control ferrule to the barrel.

The control ferrule includes a magnetic attractive member engaged in the free end portion of the control ferrule for attracting a fastener to the tool member. The magnetic attractive member includes an opening formed therein for receiving the tool member and for allowing the tool member to be engaged into the control ferrule and the compartment of the tool stem.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
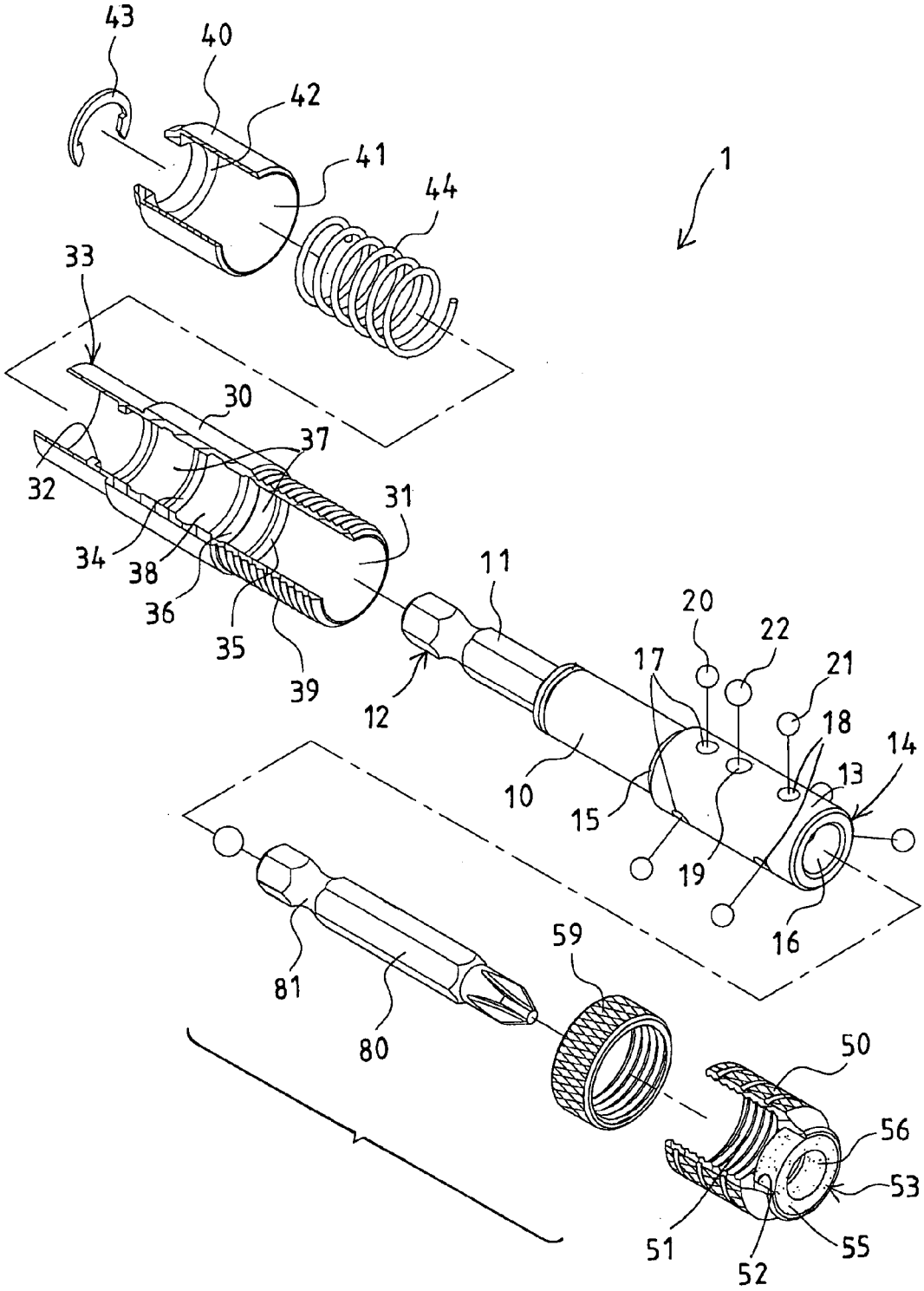
FIG. 1 is a partial exploded view of a tool retaining device for a power tool in accordance with the present invention.
Figure 2:
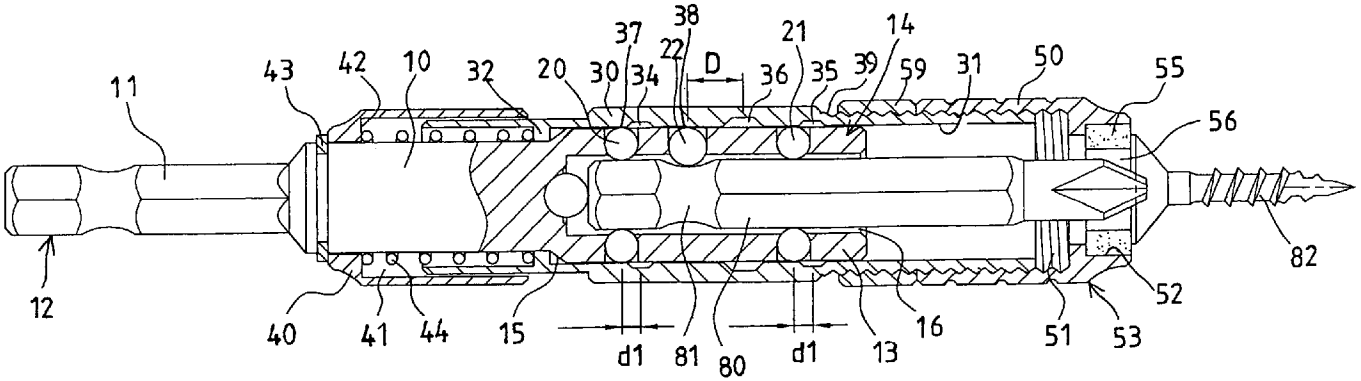
FIG. 2 is a cross sectional view of the tool retaining device.

Referring to the drawings, and initially to FIGS. 1 and 2, a tool retaining device 1 in accordance with the present invention comprises a tool stem 10 including a non-circular tool shank 11 extended from one end portion 12 thereof for coupling to such as a power tool (not shown) and for allowing the tool shank 11 and thus the tool stem 10 to be rotated or driven by the power tool, and including an outer diameter enlarged or increased engaging portion or segment 13 provided or formed in the other end portion 14 thereof for forming an outer peripheral shoulder 15 between the tool stem 10 and the engaging portion or segment 13, and including a compartment 16 formed in the engaging segment 13 or in the other end portion 14 of the tool stem 10 and having a circular cross section for receiving a tool member 80 therein.

The tool member 80 includes a non-circular cross section and is slidably and rotatably engaged in the compartment 16 of the tool stem 10, and includes a peripheral groove 81 formed in the outer peripheral portion thereof. The tool stem 10 further includes one or more (such as three) apertures 17 and one or more (such as three) orifices 18 formed in or around the engaging segment 13 or in the other end portion 14 of the tool stem 10 and intersecting or communicating with the compartment 16 of the tool stem 10 for slidably receiving or engaging with detents 20, 21 respectively, and includes one or more openings 19 formed in or around the engaging segment 13 or in the other end portion 14 of the tool stem 10 and intersecting or communicating with the compartment 16 of the tool stem 10 for slidably receiving or engaging with locking balls 22.

Figure 3:
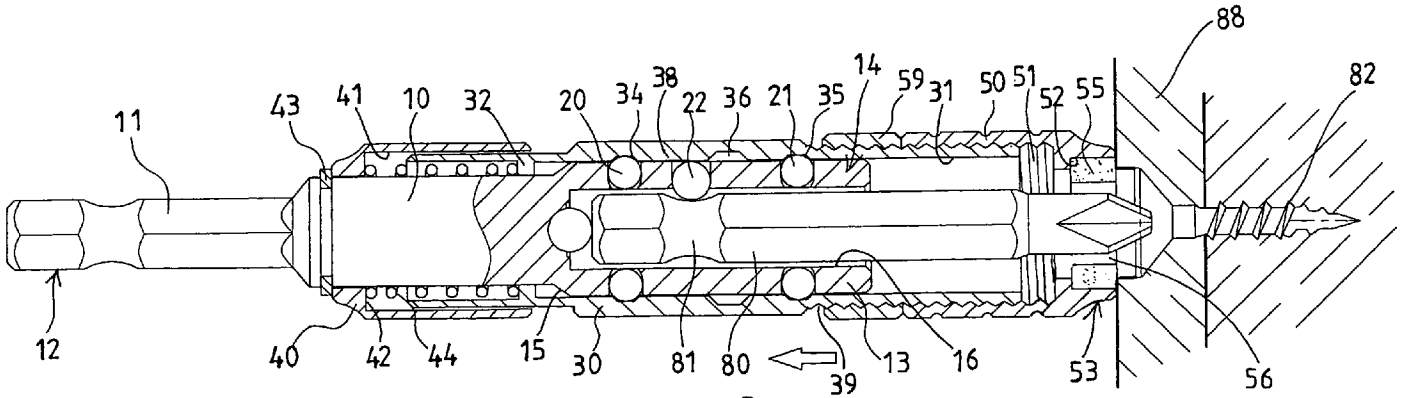
FIGS. 3 and 4 are cross sectional views similar to FIG. 2 illustrating the operation of the tool retaining device.
Figure 4:
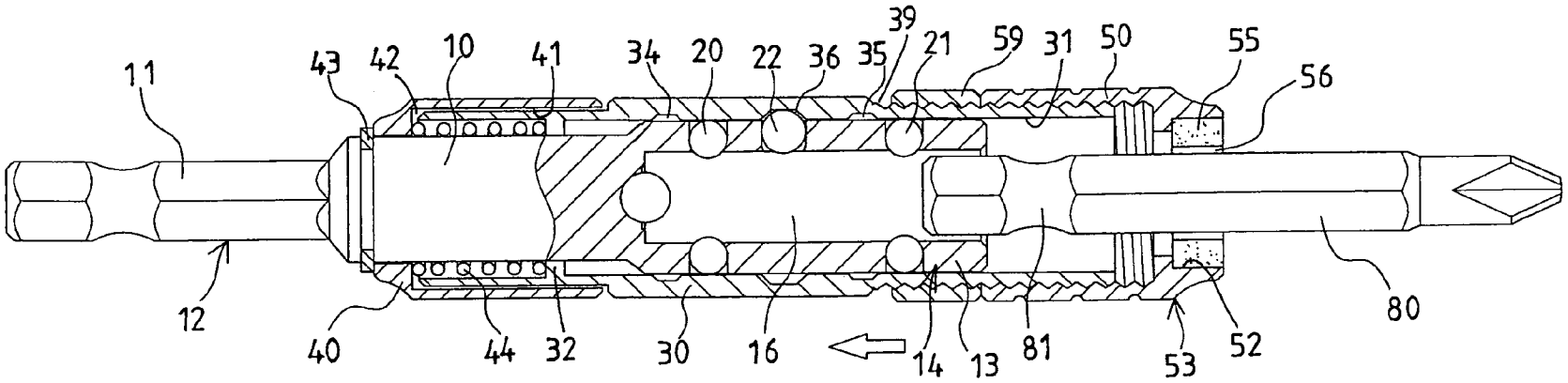

The detents 20, 21 are engageable into the compartment 16 of the tool stem 10 (FIGS. 2, 4) for selectively engaging with the tool member 80 (FIG. 2) and for anchoring or securing the tool member 80 to the tool stem 10 and for allowing the tool member 80 to be rotated or driven by the tool stem 10, and the locking balls 22 are also engageable into the compartment 16 of the tool stem 10 (FIGS. 2, 3) for selectively engaging with the peripheral groove 81 of the tool member 80 and for stably locking or securing the tool member 80 to the tool stem 10 and for preventing the tool member 80 from being disengaged from the tool stem 10, and arranged for allowing the tool member 80 to be selectively engaged into or disengaged from the compartment 16 of the tool stem 10 when the locking balls 22 are moved out or disengaged from the compartment 16 of the tool stem 10 (FIG. 4).

A barrel 30 is slidably and rotatably engaged onto the tool stem 10, and includes a bore 31 formed therein for slidably and rotatably receiving or engaging with the tool stem 10, and includes a peripheral rib 32 extended into the bore 31 of the barrel 30 at one end portion 33 thereof for engaging with the outer peripheral shoulder 15 of the tool stem 10 and for limiting the barrel 30 to slide relative to the tool stem 10, and includes one or more (such as two) peripheral slots 34, 35 and a peripheral recess 36 formed in the inner peripheral portion thereof for selectively receiving or engaging with the detents 20, 21 and the locking balls 22 respectively and for allowing the detents 20, 21 and the locking balls 22 to be selectively disengaged from the tool member 80 and the peripheral groove 81 of the tool member 80 respectively (FIGS. 3, 4).

The barrel 30 includes one or more (such as two) peripheral actuators 37 formed or provided therein, such as formed by the peripheral slots 34, 35 of the barrel 30, and located beside the peripheral slots 34, 35 of the barrel 30 for selectively engaging with the detents 20, 21 (FIGS. 2, 4) and for selectively forcing or actuating the detents 20, 21 to engage into the compartment 16 of the tool stem 10 (FIGS. 2, 4) and to selectively engage with the tool member 80 (FIG. 2). The barrel 30 further includes an inner peripheral actuator 38 formed or provided therein, such as formed by the peripheral recess 36 of the barrel 30, and located beside the peripheral recess 36 of the barrel 30 for selectively engaging with the locking balls 22 (FIGS. 2, 3) and for selectively forcing or actuating the locking balls 22 to engage into the compartment 16 of the tool stem 10 (FIGS. 2, 3) and to selectively engage with the peripheral groove 81 of the tool member 80.

A sleeve 40 is slidably and rotatably engaged onto the tool stem 10 and the one end portion 33 of the barrel 30, and also includes a bore 41 formed therein for slidably and rotatably receiving or engaging with the tool stem 10 and the one end portion 33 of the barrel 30, and includes an inner peripheral shoulder 42 formed therein, and a clamping or retaining ring 43 is engaged onto the tool stem 10 and engaged with the barrel 30 for anchoring or securing the barrel 30 to the tool stem 10. A spring biasing means or member 44 is also engaged onto the tool stem 10 and engaged with the inner peripheral shoulder 42 of the sleeve 40 and the peripheral rib 32 of the barrel 30 for forcing or biasing the barrel 30 to move away from the sleeve 40 and for forcing the peripheral rib 32 of the barrel 30 toward or to engage with the outer peripheral shoulder 15 of the tool stem 10 (FIG. 2), and thus for forcing or actuating the actuators 37, 38 to engage with the detents 20, 21 and the locking balls 22 respectively.

It is preferable that the distance dl between the detents 20, 21 and the peripheral slots 34, 35 of the barrel 30 is smaller or shorter than the distance D between the locking balls 22 and the peripheral recess 36 of the barrel 30 when the peripheral rib 32 of the barrel 30 is biased and forced to engage with the outer peripheral shoulder 15 of the tool stem 10 (FIG. 2). When the barrel 30 is slid or moved relative to the tool stem 10 and moved toward the sleeve 40 and when the spring biasing member 44 is depressed by the barrel 30, the detents 20, 21 may first be engaged into the peripheral slots 34, 35 of the barrel 30 (FIG. 3) to allow the tool member 80 to be freely rotated relative to the tool stem 10, but the locking balls 22 are still spaced from the peripheral recess 36 of the barrel 30, and the actuator 38 may still be engaged with the locking balls 22 for forcing or actuating the locking balls 22 to engage with the peripheral groove 81 of the tool member 80 and thus for rotatably securing and retaining the tool member 80 to the tool stem 10.

When the barrel 30 is further slid or moved relative to the tool stem 10 and further moved toward the sleeve 40 and when the spring biasing member 44 is further depressed by the barrel 30, as shown in FIG. 4, the locking balls 22 may be engaged into the peripheral recess 36 of the barrel 30 and may be disengaged from the tool stem 10 for allowing the tool member 80 to be selectively engaged into or disengaged from the compartment 16 of the tool stem 10, the barrel 30 includes an outer thread 39 formed on the outer peripheral portion thereof for threading or engaging with a control ferrule 50 and a lock nut 59. For example, the control ferrule 50 includes an inner thread 51 formed in the inner peripheral portion thereof for threading or engaging with the outer thread 39 of the barrel 30, and the lock nut 59 may be engaged with the control ferrule 50 for solidly securing and anchoring the control ferrule 50 to the barrel 30.

The control ferrule 50 includes an inner peripheral space 52 formed in the outer or free end portion 53 thereof for receiving or engaging with a magnetic attractive member 55 which may be solidly secured to the control ferrule 50 with such as force-fitted engagements or adhesive materials or by welding processes, and the free end portion 53 of the control ferrule 50 is extended out of the barrel 30, and the attractive or magnetic member 55 includes an opening 56 formed therein for receiving the tool member 80 (FIGS. 2-4) and for allowing the tool member 80 to be engaged into the control ferrule 50 and the compartment 16 of the tool stem 10, and the magnetic member 55 may be provided or used for attracting or securing a fastener 82 to the tool member 80 (FIGS. 2, 3) and for preventing the fastener 82 from being disengaged from the tool member 80 and for allowing the fastener 82 to be stably rotated or driven by the tool member 80.

In operation, as shown in FIG. 2, a fastener 82 may be attracted or secured to the tool member 80 with the magnetic member 55, and the detents 20, 21 and the locking balls 22 may be actuated by the actuators 37, 38 to engage with the tool member 80 and the peripheral groove 81 of the tool member 80 respectively for allowing the tool member 80 and thus the fastener 82 to be stably rotated or driven by the tool stem 10. As shown in FIG. 3, the fastener 82 may be fully threaded or engaged into the wall member or work piece 88 when the free end portion 53 of the control ferrule 50 is engaged with or onto the wall member or work piece 88, and the control ferrule 50 and thus the barrel 30 may be forced or actuated by the wall member or work piece 88 to move toward the sleeve 40 and to depress the spring biasing member 44 when the fastener 82 is further engaged into the wall member or work piece 88.

As also shown in FIG. 3, when the fastener 82 is further engaged into the wall member or work piece 88 and when the control ferrule 50 and thus the barrel 30 are moved against the spring biasing member 44 and moved toward the sleeve 40, the actuators 37, 38 may first be disengaged from the detents 20, 21, and the detents 20, 21 may be selectively received or engaged into the peripheral slots 34, 35 of the barrel 30 and may thus be disengaged from the tool stem 10 to allow the tool member 80 to be freely rotated relative to the tool stem 10. It is to be noted that, at this moment, the locking balls 22 are still spaced from the peripheral recess 36 of the barrel 30, and the actuator 38 may still be engaged with the locking balls 22 for forcing or actuating the locking balls 22 to engage with the peripheral groove 81 of the tool member 80 and thus for rotatably securing and retaining the tool member 80 to the tool stem 10 and for preventing the tool member 80 from being further rotated or driven by the tool stem 10.

As also shown in FIG. 4, when the barrel 30 is further slid or moved relative to the tool stem 10 and further moved toward the sleeve 40 and when the spring biasing member 44 is further depressed by the barrel 30, the locking balls 22 may be engaged into the peripheral recess 36 of the barrel 30 and may be disengaged from the tool stem 10 for allowing the tool member 80 to be selectively engaged into or disengaged from the compartment 16 of the tool stem 10. Accordingly, when the detents 20, 21 are received or engaged into the peripheral slots 34, 35 of the barrel 30, the tool member 80 may be freely rotated relative to the tool stem 10 and may not be rotated or driven by the tool stem 10, and the users may thus easily aware that the fastener 82 has been fully threaded or engaged into the wall member or work piece 88. The control ferrule 50 may be threaded or adjusted relative to the barrel 30 to adjust the movement of the barrel 30 relative to the tool stem 10 before the detents 20, 21 are received or engaged into the peripheral slots 34, 35 of the barrel 30.

Figure 5:
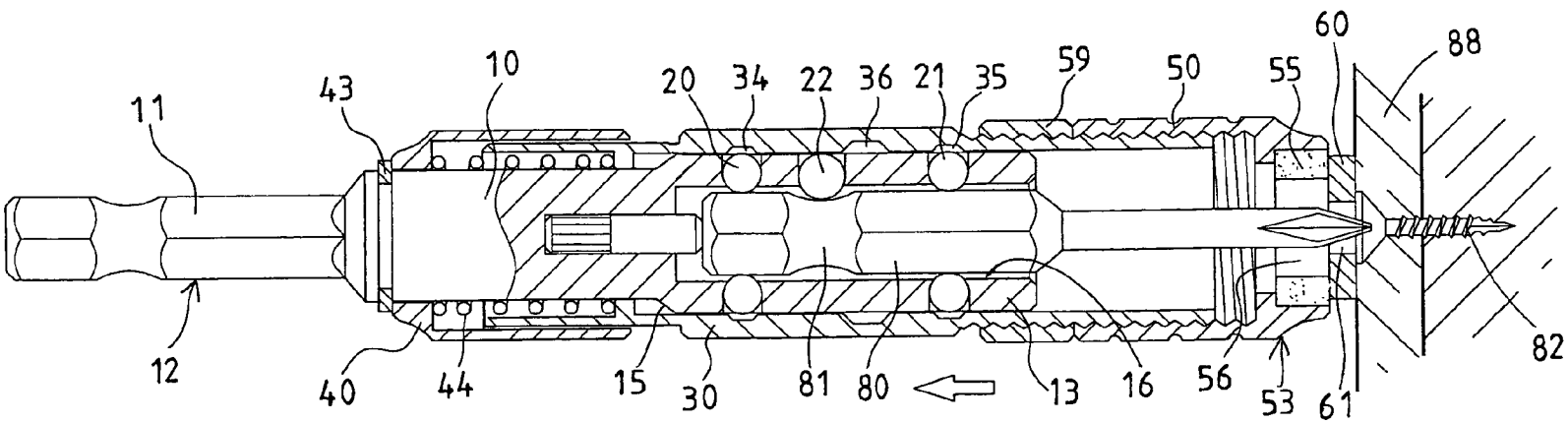
FIG. 5 is a cross sectional view similar to FIGS. 2-4, illustrating the other arrangement of the tool retaining device.

As shown in FIG. 5, a ring member 60 may further be provided and engaged with or attached to the free end portion 53 of the control ferrule 50, or engaged with or attached to the magnetic member 55, and includes a passage 61 formed therein for receiving the tool member 80 and for allowing the tool member 80 to be engaged into the control ferrule 50 and the compartment 16 of the tool stem 10, and the ring member 60 is made of magnetically attractable materials for being attracted or secured to the magnetic member 55 and/or the control ferrule 50 and for determining or adjusting the movement of the barrel 30 relative to the tool stem 10 before the detents 20, 21 are received or engaged into the peripheral slots 34, 35 of the barrel 30.

Figure 6:
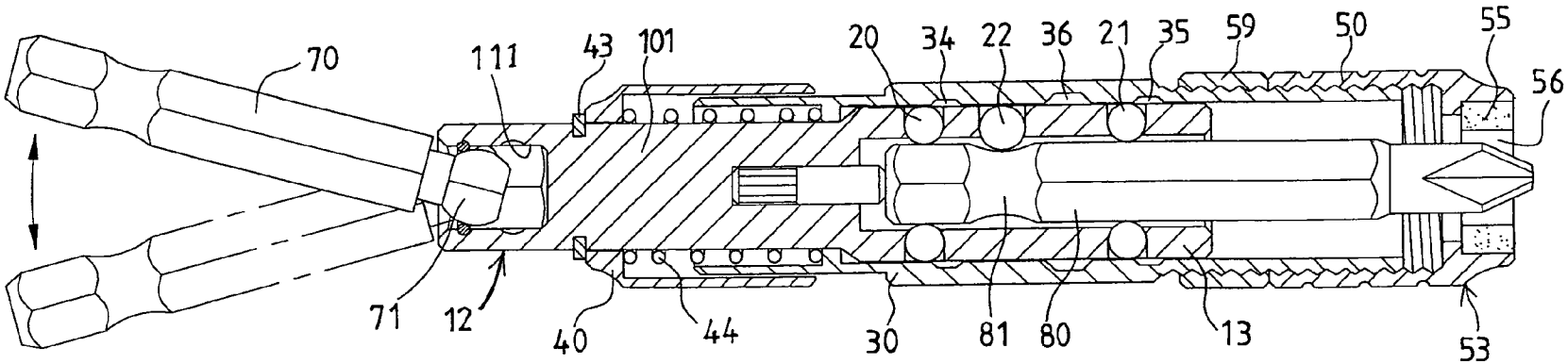
FIGS. 6, 7 are cross sectional views similar to FIGS. 2-5, illustrating the further arrangement of the tool retaining device.
Figure 7:
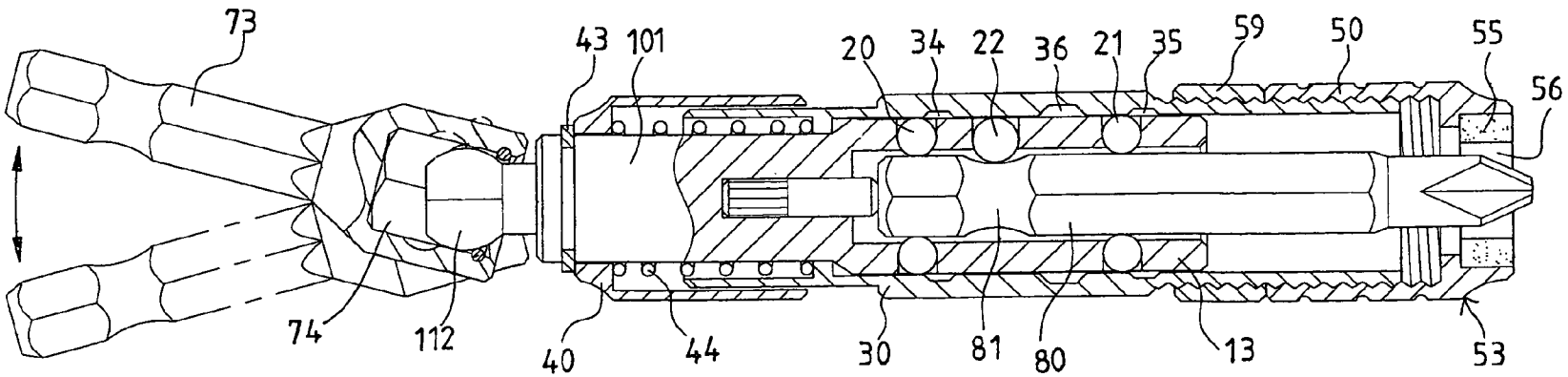

Alternatively, as shown in FIG. 6, the tool stem 101 may include an engaging hole 111 formed in the one end portion 12 thereof and having a non-circular cross section for receiving or engaging with a non-circular and spatial or three-dimensional head 71 of a tool device 70 and arranged for allowing the tool device 70 to be tilted or inclined relative to the tool stem 10. Further alternatively, as shown in FIG. 7, the tool stem 101 may include a non-circular and spatial or three-dimensional head 112 formed or provided in the one end portion 12 thereof, and another tool device 73 may include a non-circular engaging hole 74 formed therein for receiving or engaging with the non-circular and spatial or three-dimensional head 112 and for allowing the tool device 73 to be tilted or inclined relative to the tool stem 10.

Figure 8:
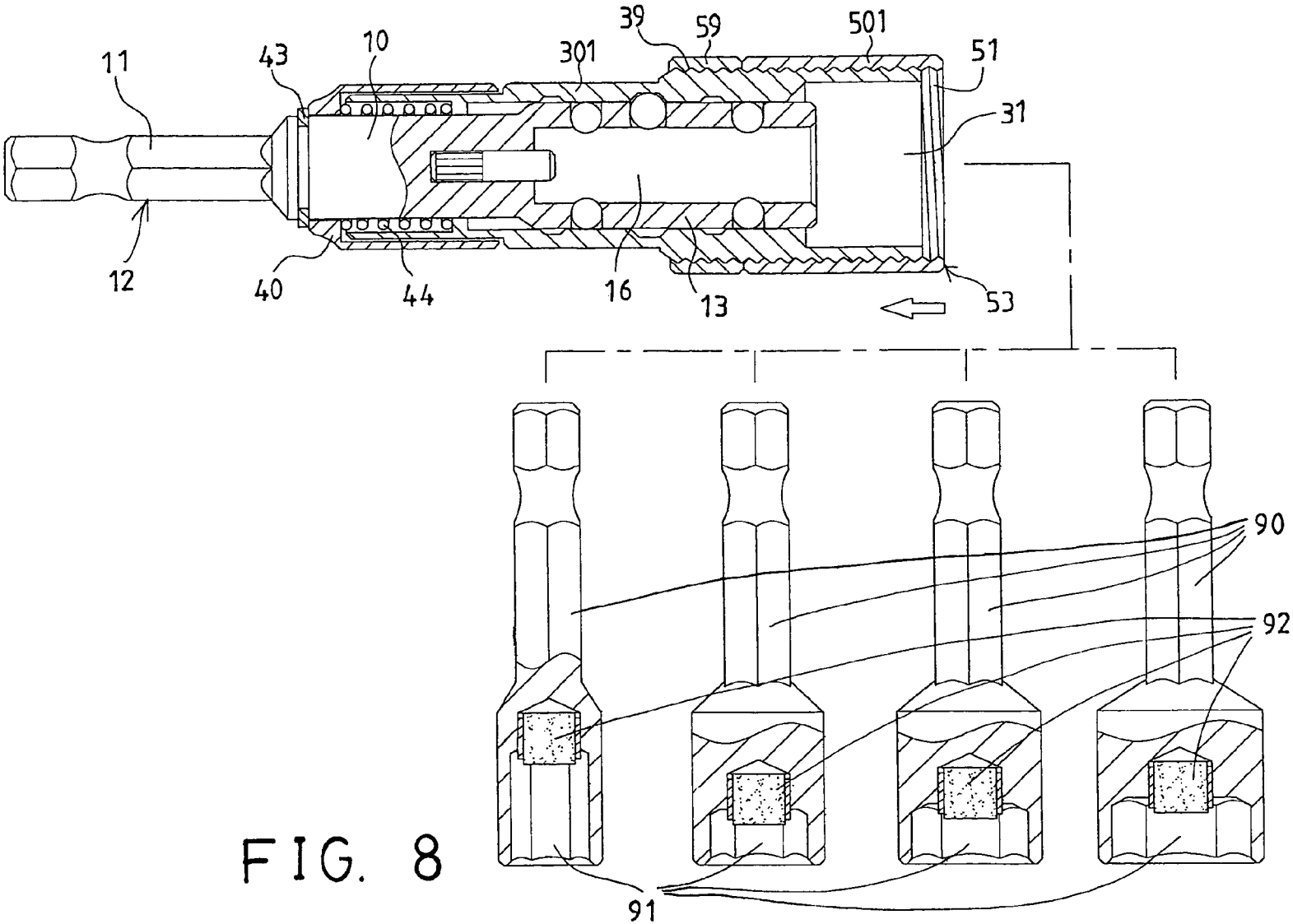
FIG. 8 is a partial exploded and cross sectional view illustrating the still further arrangement of the tool retaining device.

Further alternatively, as shown in FIG. 8, the control ferrule 501 may also be engaged onto the barrel 301, and the bore 31 of the barrel 30 may be arranged for allowing a further tool device 90 to be engaged into the bore 31 of the barrel 30 and to be engaged into the compartment 16 of the tool stem 10 for being selectively rotated or driven by the tool stem 10, and the tool device 90 may include a non-circular engaging hole 91 formed therein for receiving or engaging with the further tool elements (not shown), and may include a magnetic attractive member 92 disposed or engaged therein for attracting the further tool elements to the tool device 90.

Accordingly, the tool retaining device in accordance with the present invention includes a chuck device or structure for detachably securing a tool member to a power tool and for allowing the tool member to be driven by the power tool with a predetermined driving torque.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tool retaining device comprising:

a tool stem including an engaging segment having a compartment formed in said engaging segment, and including at least one aperture formed in said engaging segment and communicating with said compartment of said tool stem, and including at least one opening formed in said engaging segment and communicating with said compartment of said tool stem, a tool member receivable and engageable into said compartment of said engaging segment of said tool stem and including a peripheral groove formed in an outer peripheral portion thereof, at least one detent slidably received and engaged with said at least one aperture of said tool stem and selectively engageable into said compartment of said tool stem for selectively engaging with said tool member and for anchoring said tool member to said tool stem and for allowing said tool member to be rotated and driven by said tool stem, at least one locking ball slidably received and engaged with said at least one opening of said tool stem and selectively engageable into said compartment of said tool stem for selectively engaging with said tool member and for rotatably anchoring and securing said tool member to said tool stem and for preventing said tool member from being disengaged from said tool stem, and a barrel slidably and rotatably engaged onto said tool stem, and including a bore formed therein for slidably and rotatably receiving said tool stem, and including at least one peripheral slot and at least one peripheral recess formed in said barrel for selectively receiving said at least one detent and said at least one locking ball respectively and for allowing said at least one detent and said at least one locking ball to be selectively disengaged from said tool member, and said barrel including a first actuator formed by and located beside said at least one peripheral slot of said barrel for selectively engaging with said at least one detent and for selectively actuating said at least one detent to engage into said compartment of said tool stem and to selectively engage with said tool member, and said barrel including a second actuator formed by and located beside said at least one peripheral recess of said barrel for selectively engaging with said at least one locking ball and for selectively actuating said at least one locking ball to engage into said compartment of said tool stem and to selectively engage with said peripheral groove of said tool member, and said at least one peripheral recess of said barrel being disengaged from said at least one locking ball and said at least one locking ball being actuated to engage with said peripheral groove of said tool member by said second actuator when said first actuator is disengaged from said at least one detent and when said at least one detent is received in said at least one peripheral slot of said barrel, in order to lock said tool member to said tool stem and to prevent said tool member from being disengaged from said tool stem, and to allow said tool member to be freely rotated relative to said tool stem, and said at least one detent being disengaged from said at least one peripheral slot of said barrel, and said first actuator being engageable with said at least one detent when said second actuator is disengaged from said at least one locking ball and when said at least one locking ball is received in said at least one peripheral recess of said barrel to allow said tool member to be selectively engaged into or disengaged from said compartment of said tool stem.

2. The tool retaining device as claimed in claim 1, wherein said tool stem includes an outer peripheral shoulder formed therein, and said barrel includes a peripheral rib extended into said bore of said barrel for engaging with said outer peripheral shoulder of said tool stem and for limiting said barrel to slide relative to said tool stem.

3. The tool retaining device as claimed in claim 2, wherein a spring biasing member is engaged onto said tool stem and engaged with said peripheral rib of said barrel for biasing said peripheral rib of said barrel toward said outer peripheral shoulder of said tool stem.

4. The tool retaining device as claimed in claim 3, wherein a sleeve is engaged onto said tool stem and engaged with said spring biasing member, and includes a bore formed therein for receiving said spring biasing member and for partially receiving said barrel.

5. The tool retaining device as claimed in claim 1, wherein said barrel includes an outer thread formed thereon, and a control ferrule includes an inner thread formed therein for threading and engaging with said outer thread of said barrel and includes a free end portion extended out of said barrel for engaging with a work piece.

6. The tool retaining device as claimed in claim 5, wherein a lock nut is threaded and engaged with said outer thread of said barrel and engageable with said control ferrule for securing and anchoring said control ferrule to said barrel.

7. The tool retaining device as claimed in claim 5, wherein said control ferrule includes a magnetic attractive member engaged in said free end portion of said control ferrule for attracting a fastener to said tool member.

8. The tool retaining device as claimed in claim 7, wherein said magnetic attractive member includes an opening formed therein for receiving said tool member and for allowing said tool member to be engaged into said control ferrule and said compartment of said tool stem.

* * * * *